United States Patent [19]

Van Buskirk

[11] Patent Number: 4,696,227

[45] Date of Patent: Sep. 29, 1987

[54] PRESS FOR COMPACTING SMALL SCALE OBJECTS

[76] Inventor: W. Jeffrey Van Buskirk, P.O. Box 1385, 302 S. Leach St., Hobbs, N. Mex. 88240

[21] Appl. No.: 863,695

[22] Filed: May 16, 1986

[51] Int. Cl.[4] ..... B30B 1/16; B30B 1/42

[52] U.S. Cl. ..... 100/902; 100/90; 100/917; 100/245

[58] Field of Search ..... 100/902, 245, 269 R, 100/265, 917, 295, 90

[56] References Cited

U.S. PATENT DOCUMENTS

| | | | |
|---|---|---|---|
| 59,475 | 11/1866 | Stevens | 100/90 |
| 293,335 | 2/1884 | Knapp | 100/90 X |
| 703,952 | 7/1902 | Borie | 100/917 X |
| 1,703,783 | 2/1929 | Schmidt | 100/265 X |
| 2,707,503 | 5/1955 | Johnson | 100/902 X |
| 2,951,437 | 9/1960 | Diener | 100/256 |
| 3,835,767 | 9/1974 | Peterson | 100/295 X |
| 3,889,587 | 6/1975 | Wharton | 100/902 X |
| 4,128,055 | 12/1978 | Hellmann | 100/265 X |
| 4,210,065 | 7/1980 | Switzer | 100/269 R X |
| 4,459,906 | 7/1984 | Cound | 100/902 X |

FOREIGN PATENT DOCUMENTS

| | | | |
|---|---|---|---|
| 1922557 | 2/1970 | Fed. Rep. of Germany | 100/917 |
| 0821018 | 4/1981 | U.S.S.R. | 100/917 |

*Primary Examiner*—Peter Feldman

*Attorney, Agent, or Firm*—Burns, Doane, Swecker & Mathis

[57] ABSTRACT

A press is provided for compacting small scale objects such as beverage cans. The press includes a hollow, cylindrical housing having a floor and sidewalls extending substantially perpendicularly therefrom to define a housing cavity, a compacting arrangement slidable within the cavity, the compacting arrangement being arranged to travel within the cavity in close proximity to the sidewalls of the housing, and an arrangement for drawing the compacting means downwards toward the floor of the housing. The drawing arrangment may include an arrangement for producing negative pressure within the housing cavity or an electromagnet and is capable of drawing the compacting arrangement toward the floor of the housing with sufficient force to substantially crush an object positioned between the compacting arrangement and the floor of the housing.

23 Claims, 6 Drawing Figures

10

23
56
12
72
68
70
20
59
61
66
22
58'
61
60
L
16
80
6
41
6
18
40
38
36
19
34
42
32
14
39
44
24
26
28
30

Fig. 3
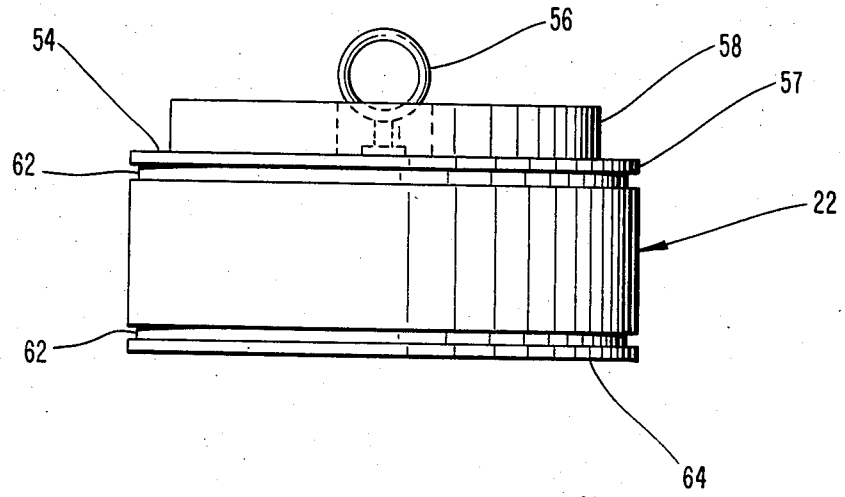
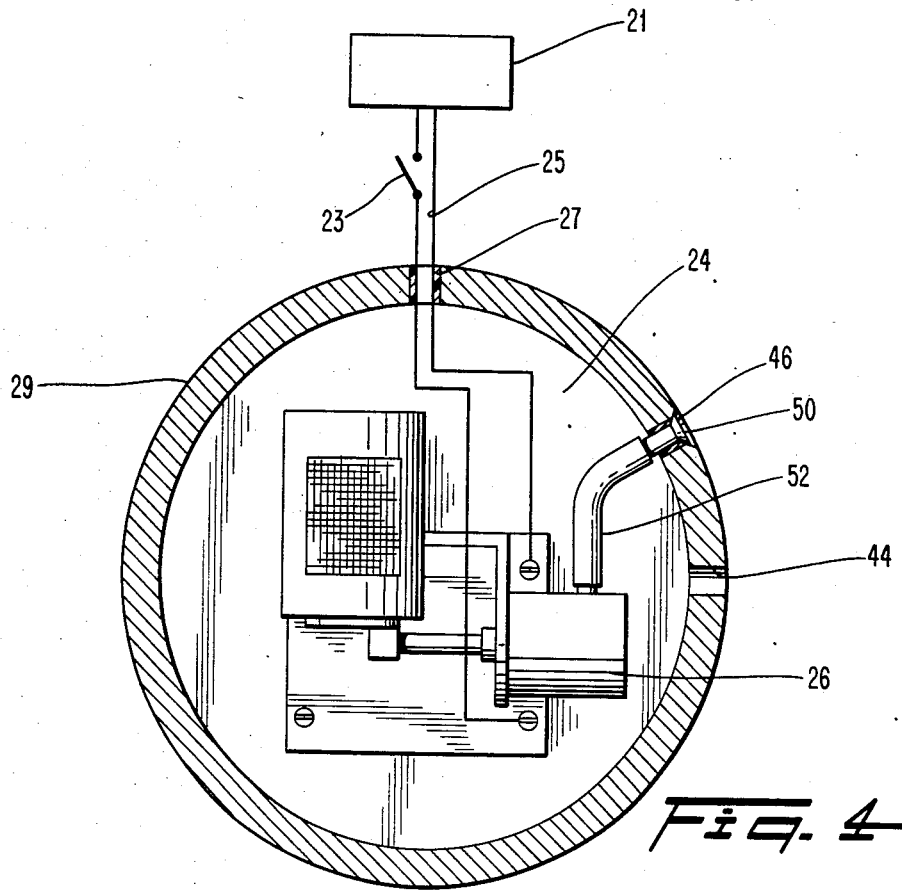
Fig. 4

PRESS FOR COMPACTING SMALL SCALE OBJECTS

BACKGROUND OF THE INVENTION

1. Field of the Invention

This invention relates to small compacting devices. More particularly, the present invention relates to compacting devices of the novelty or display type for crushing small scale objects such as aluminum soft drink and beer cans.

2. Description of the Prior Art

Devices for compacting objects such as aluminum beverage cans are known in the art. One known compacting arrangement is disclosed in U.S. Pat. No. 4,210,065. This patent discloses a valve for controlling a fluid pressure operated device such as a crushing mechanism. The crushing mechanism includes a cylindrical body fixedly mounted to a base. The body defines a cylindrical bore which is closed at its lower end by the base and at its upper end by a lid. A piston reciprocally mounted within the cylindrical bore of the crushing mechanism forms a pressurization chamber below the piston and a working chamber above the piston. Selective operation of a valve directs fluid such as compressed air into the working chamber beneath the piston to cause upward sliding movement of the piston to crush an article such as a beverage can placed in the working chamber. Positive pressure is developed to move the piston against gravity and into engagement with the can during the work stroke of the piston.

An apparatus for evacuating and compacting filled aerosol cans is disclosed in U.S. Pat. No. 4,459,906. The apparatus includes an inclined feed chute which directs aerosol cans placed therein into a crushing chamber. The crushing chamber includes a hydraulic ram mounted for reciprocal movement within the chamber. Various logic systems operate to direct a piercing tip into engagement with an end of an aerosol can situated within the chamber and to direct the reciprocal movement of the ram. Positive pressure is used to urge the piston into engagement with the aerosol can.

U.S Pat. No. 2,951,437 discloses an electromagnetic press for compacting articles. The press is electronically controlled and includes plurality of magnetic coils and armatures for crushing objects placed between a press punch and a work platform.

The known compacting devices, however, do not provide an arrangement of the novelty or display type for crushing articles such as beverage cans which is compact in size and weight and is inexpensive to produce so that it is readily affordable to the consumer for use in the home or in a retail environment for display purposes.

Accordingly, it is an object of the present invention to provide a press for compacting small scale objects such as single serving beverage cans that is compact in size and inexpensive to produce.

Another object of the present invention is to provide a press for compacting small scale objects such as single serving beverage cans that is easy and safe to operate.

Still another object of the present invention is to provide a press for compacting small scale objects such as single serving beverage cans that is attractive in appearance and is visually stimulating to watch in operation.

Yet another object of the present invention is to promote beverage can recycling efforts by providing a press for compacting single serving beverage cans and has a substantially transparent housing that permits a user to observe the compacting process.

Still another object of the present invention is to provide a press for compacting small scale objects such as single serving beverage cans that is inexpensive to operate and maintain.

These and other objects and features of the claimed invention will be apparent from the following written description and claims, considered with the drawings herein.

SUMMARY OF THE INVENTION

The invention pertains to a press for compacting small scale objects. The press includes a hollow, cylindrical housing having a floor and sidewalls extending substantially perpendicularly therefrom to define a housing cavity. Compacting means including means arranged to travel with the compacting means are arranged within the housing cavity to slide within the housing in close proximity to the cavity sidewalls. Means are provided for drawing the compacting means toward the floor of the housing. The drawing means are arranged to draw the compacting means downwardly with sufficient force to substantially crush an object positioned between the compacting means and the floor of the housing.

In a first embodiment, the compacting means includes a piston and the means for drawing the piston toward the floor of the housing including means for producing negative pressure within the housing beneath the piston. In a second embodiment, the compacting means includes a piston made of a magnetic material and the means for drawing the piston toward the floor of the housing comprises an electromagnet. In either embodiment, the force of gravity aids in moving the piston downwardly.

In a further aspect of the present invention, at least a portion of the housing is transparent to visible light to permit viewing by the user and includes a plurality of reinforcing ribs. Each of the reinforcing ribs extends radially outwardly from the housing along at least a portion of the housing length to further stabilize the sidewalls of the press.

In accordance with a further aspect of the present invention, a selectively fillable cavity is formed within the piston to change the mass of the piston and to vary the performance characteristics of the press. These performance characteristics include the rate at which a can is crushed and the ability to crush objects having various sizes, configurations and rigidities.

In a preferred embodiment, a vacuum pump is mounted within a chamber adjacent the housing. The chamber includes a vent port for relieving pressure within the chamber. The vacuum pump is arranged to develop sufficient negative pressure within the press housing to draw the piston downwardly toward the floor of the housing with sufficient force to substantially crush an object positioned between the piston and the floor of the housing.

BRIEF DESCRIPTION OF THE DRAWINGS

Preferred embodiments of the present invention will be described in greater detail with reference to the accompanying drawings, wherein like members bear like reference numerals and wherein:

FIG. 3 is a side view of a piston used in the embodiment of the press depicted in FIG. 1;

FIG. 4 is a top view along the section line 4—4 of FIG. 1;

DETAILED DESCRIPTION OF THE PREFERRED EMBODIMENTS

Figure 1:
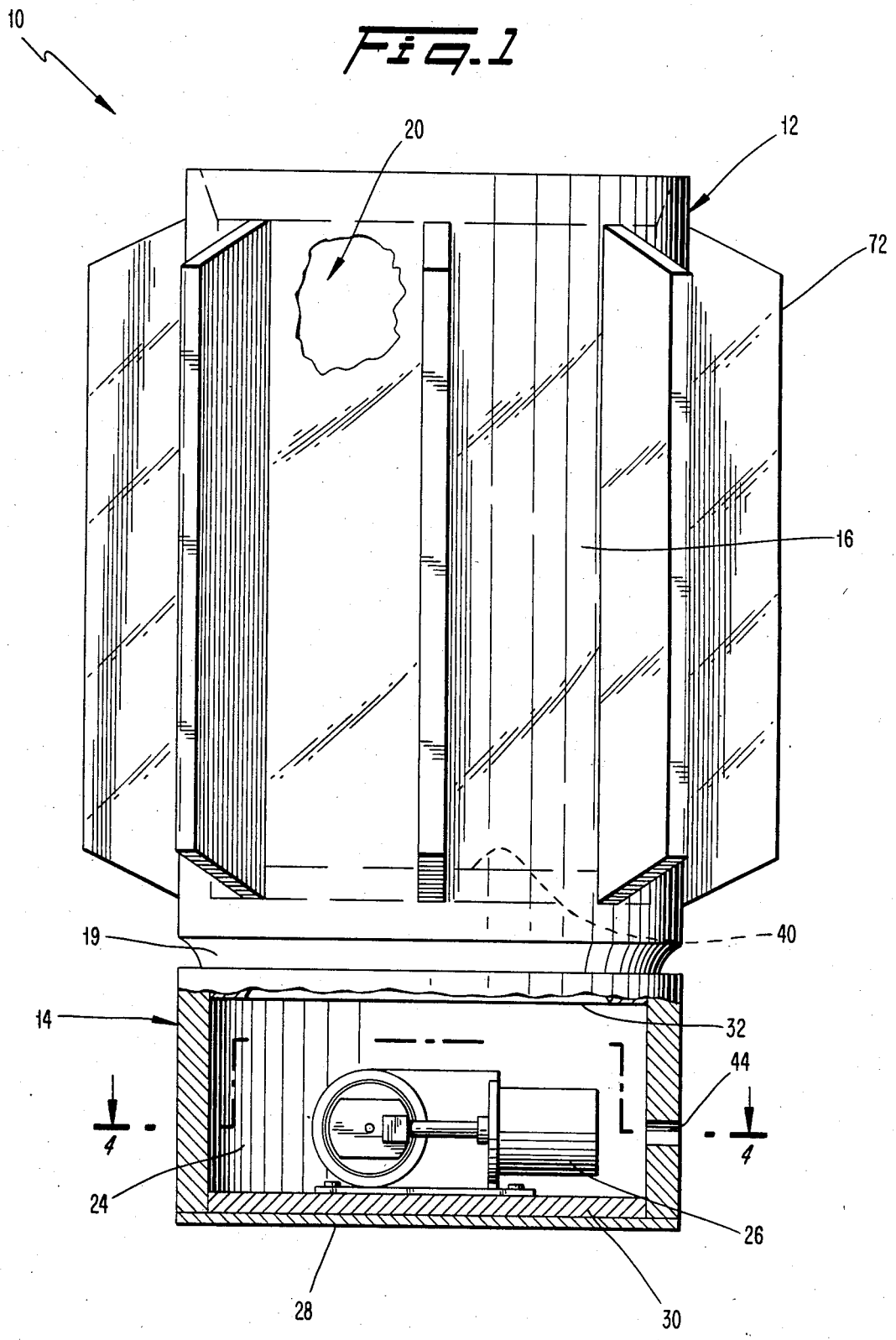
FIG. 1 is a side, partially cut-away view of one embodiment of the press.
Figure 2:
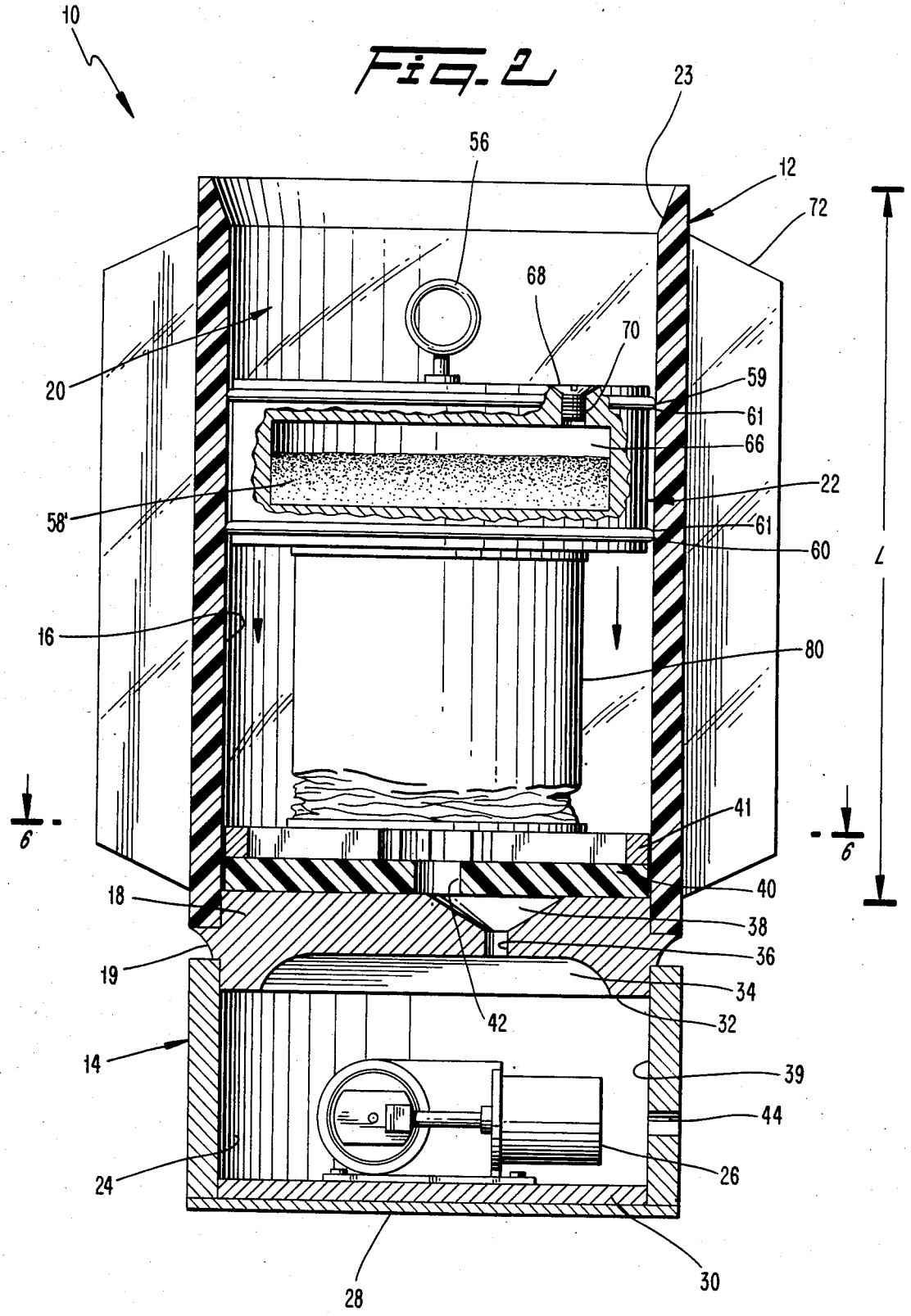
FIG. 2 is a side, partially cut-away view of the embodiment of the press depicted in FIG. 1 in operation with a beverage can depicted in partial compression.

With reference to FIGS. 1 and 2, a press 10 is provided for compacting small scale objects such as single serving aluminum beverage containers. The press includes a housing 12 mounted on a base 14. The housing is generally cylindrical in shape and preferably includes sidewalls 16 that extend substantially perpendicularly from housing floor 18 and the base 14. The housing floor 18 extends from a connecting plate 19 and is connected to the sidewalls 16 of the housing by a snap-fit connection. A cylindrical cavity 20, preferably circular in cross-section, is defined between the sidewalls 16 of the housing 12. The cavity 20 is arranged to receive compacting means 22 such as a piston that is slidably receivable longitudinally with respect to the housing 12. The upper ends 23 of the sidewalls 16 are flared outwardly from the housing cavity 20 to facilitate insertion of the compacting means 22 into the cavity 20.

The base 14 preferably houses in a chamber 24 an arrangement 26 for drawing the compacting means 22 or piston toward the floor 18 of the housing. In a first embodiment, the drawing arrangement 26 includes a vacuum pump for producing negative pressure within the portion of the housing cavity 20 beneath the piston 22. The vacuum pump 26 may be of any suitable type, such as the positive displacement reciprocating piston variety, for example, the portable type made by Inter T.M. Compressor Corp. of Culver City, Calif. that is used for inflating automobile and bicycle tires. The pump 26 is secured to a base bottom 28 through a mounting plate 30 and is powered by a conventional power source 21 (FIG. 4), such as direct or alternating current.

Power is supplied to the pump 26 through a circuit preferably including a switch 23 positioned along one of two leads 25. The leads extend between the power source 21 and the pump 26 through an aperture 27 formed in a wall 29 of the chamber 24. The aperture 27 is sealed in a conventional manner, as with silicon sealant, to quell leakage from the chamber 24.

With reference to FIGS. 1 and 2, a ceiling 32 of the chamber 24 includes a recess 34 having an orifice 36 which communicates with the housing cavity 20 through a channel 38 formed in the housing floor 18. The housing floor 18, connecting plate 19 and chamber ceiling 32 are preferably machined from a single piece of metal, such as a Caterpillar® diesel engine piston with reduced diameter sections at either end. This arrangement provides a double pin connection for connection with the housing sidewalls 16 (discussed above) and with the sidewalls 39 of the base 14. In one aspect of the first embodiment, a diverter of the negative pressure generated by the vacuum pump 26 is provided. The diverter includes a removable plate 40 having an aperture 42 formed therein. The plate 40 is arranged to be positioned adjacent the housing floor 18 so that the aperture 42 at least partially overlaps the channel 38. The partial overlap of the aperture 42 and channel 38 provides for the removal of air first from the interior of a beverage can 80 having its opening positioned adjacent the aperture 42 prior to substantial removal of the air from the housing cavity 20. The more complete removal of air from the cavity 20 is accomplished after partial compaction of the can which breaks any possible seal formed between the perimeter of the can and the upper surface of the plate 40.

Figure 6:
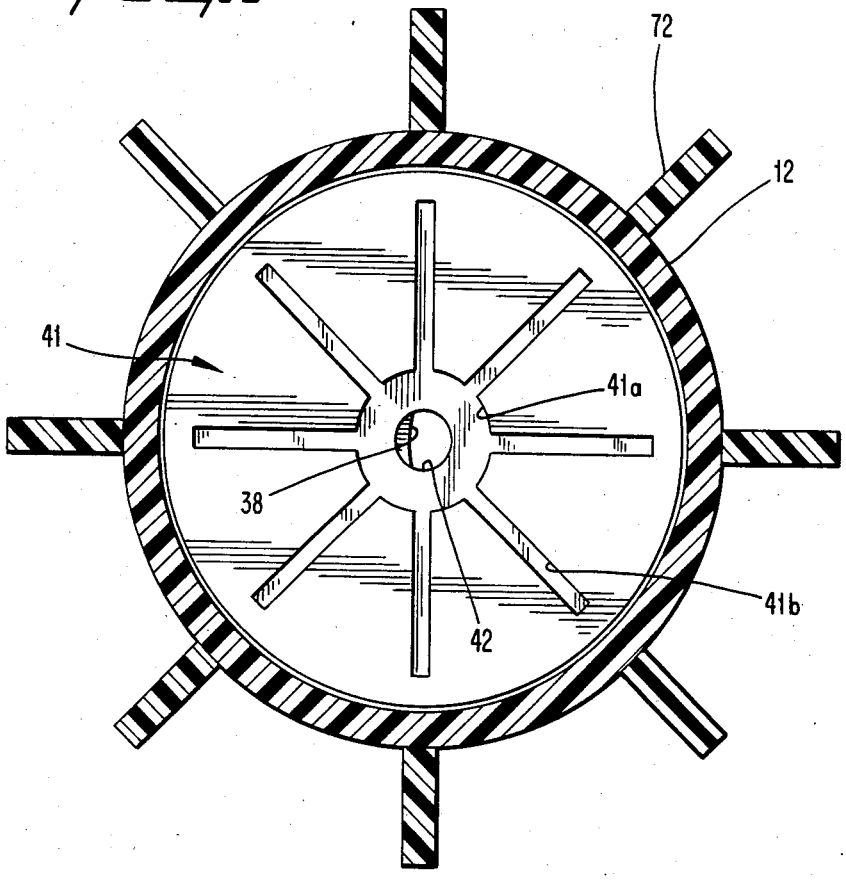
FIG. 6 is a perspective view of one embodiment of the dispersion plate illustrated in FIG. 2.

In another aspect of the invention, the diverter also includes a removable flow dispersion plate 41 (FIGS. 2 and 6). The flow dispersion plate 41 includes a central orifice 41*a* arranged for substantial alignment with the aperture 42 of the plate 40 when the dispersion plate 41 is positioned over the plate 40. A plurality of passages 41*b* (FIG. 6) extend radially outwardly from the orifice 41*a* to direct evacuation of a peripheral portion of the housing cavity 20 beneath the piston substantially simultaneously with evacuation of the interior of the can 80. The arrangement of the diverter including the removable plate 40 with the aperture formed therein and the flow dispersion plate 41 with the orifice 41*a* and passages 41*b* radiating therefrom may also be formed as a unitary removable plate or as a part of the housing floor 18. Alternatively, the diverter may be omitted when a piston having a sufficiently large surface area and mass is utilized.

With reference to FIG. 4, a vent port 44 and an exhaust port 46 are formed in the wall 29 of the chamber 24. The vent port 44 is provided to selectively relieve pressure within the chamber and is in the form of a small, selectively closable passage which extends through the wall 29 of the chamber 24 to the external environment of the press. The vent port 44 may be manually actuated, as by placing a finger over the passage to close off the chamber 24, or may be actuated by any suitable, manually closable valving arrangement. Selective opening of the vent port 44 permits atmospheric air to enter the chamber 24 and housing cavity 20 to facilitate removal of the piston 22 following operation of the press. The exhaust port 46 includes a bore and counter bore and also extends through the wall 29 of the chamber. A flared connector 50 is seated within the counter bore and is sealed in a suitable manner, as with silicon sealant. The flared connector 50 extends into the interior of the chamber 24 to connect with an exhaust hose 52 extending from the pump 26. Atmosphere pumped from the housing cavity 20 passes from the press through the exhaust port 46 and into the environment surrounding the press, creating a vacuum in the space beneath the piston 22.

Turning now to FIGS. 2 and 3, the piston 22 for compacting objects such as beverage cans is placed in the cavity 20 of the press housing 12. The piston 22 is provided with sufficient mass to facilitate crushing of objects positioned thereunder and is arranged to travel substantially the length L of the cavity 20 upon actuation of the drawing means 26 under the influence of gravity. The piston 22 may be of relatively simple construction, such as that used in a Caterpillar® diesel engine, having an aluminium and steel laminated construction. An upper end 54 of the piston 22 includes a post 56 which may be in the form of an eye hook to facilitate handling of the piston 22 by the press operator. The upper end 54 of the piston 22 is dimensioned to receive mass changing means 58 such as one or more removable weights. These additional weights may be added to facilitate crushing of especially rigid beverage cans or to otherwise modify the performance characteristics of the press, as by accelerating downward movement of the piston 22. Although the upper end 54 of the piston is depicted as having a substantially flat surface, the surface may be sloped upward from the lateral edges 57 of the piston to define a piston having a substantially conical shape in cross-section. The conically-shaped piston may be provided to enhance the aesthetic qualities of the press. Further, the conically shaped piston aids in retaining weights 58 if the weights are in the form of sacks or other substantially shapeless media adapted for placement onto the upper end 54 of the piston. Such shapeless media may be provided to also help seal the piston 22 against the sidewalls 16 of the housing cavity 20.

The piston 22 preferably includes guide means 59 principally for guiding the piston along the sidewalls of the housing 12 during its travel through the cavity 20 and sealing means 60 principally for sealing the portion of the cavity between the piston 22 and the housing bottom 18. However, the guide means 59 also provides some cavity sealing and the sealing means 60 also provides some guiding assistance for the piston within the cavity. In a preferred form, each of the guide means 59 and the sealing means 60 is in the form of an O-ring 61. Each of the O-rings 61 is positioned within an annular groove 62 provided in the piston 22 (FIG. 3). The O-ring 61 provided as the guide means 59 is positioned in the groove 62 adjacent the upper end 54 of the piston 22. The O-ring 61 arranged as the sealing means 60 is positioned in the groove 62 adjacent a lower end 64 of the piston. The O-rings are preferably formed from a material that is sufficiently pliable yet rigid to withstand the stresses developed during operation of the press, such as a material like Buna N 70 Der. The guide means 59 and sealing means 61 may also be formed in one piece with the piston.

In an alternative aspect of this embodiment, the piston 22 includes a refillable cavity 66 (FIG. 2) for receiving mass changing means 58' in the form of liquid or particulate material such as lead shot or sand. The cavity 66 is dimensioned to receive a wide variety of materials and to provide a wide range of piston masses for modifying the performance characteristics of the press, as discussed above. The cavity 66 is sealed in a conventional manner, as by a removable plug 68 which extends through a bore 70 formed in the upper end 54 of the piston 22. The plug 68 and bore 70 are preferably correspondingly threaded to secure the plug within the bore. In conjunction with this and other aspects of the first embodiment, the piston may be formed from a transparent material such as acrylic or from opaque materials such as wood, copper, lead, bronze and other metals, or any combination of the above, to enhance the aesthetic qualities of the press.

The housing 12 is preferably formed from a transparent material such as acrylic to provide the operator and others with a full view of the operation of the press. Appropriate housing dimensions are selected to ensure structural integrity of the housing throughout prolonged press operation. However, the overall size and weight of the press is maintained sufficiently small so as to be manually portable. In one working press, the housing 12 is formed from acrylic and provides a circular cylindrical housing cavity having an internal diameter of 5.0 inches. The overall housing length L of the cylinder is 8.70 inches. Reinforcing ribs 72 are provided adjacent the sidewalls 16 of the housing 12 to lend additional structural rigidity to the housing and to enhance the appearance of the press. The reinforcing ribs extend radially outwardly from the housing along at least a portion of the length thereof. Preferably, eight spaced apart ribs 72 are provided. Each rib 72 is about 0.25 inch thick, 1.0 inch wide and about 7.75 inches long. The ribs 72 may be formed from any suitable material, including transparent or colored acrylic, copper, brass or wood.

Figure 5:
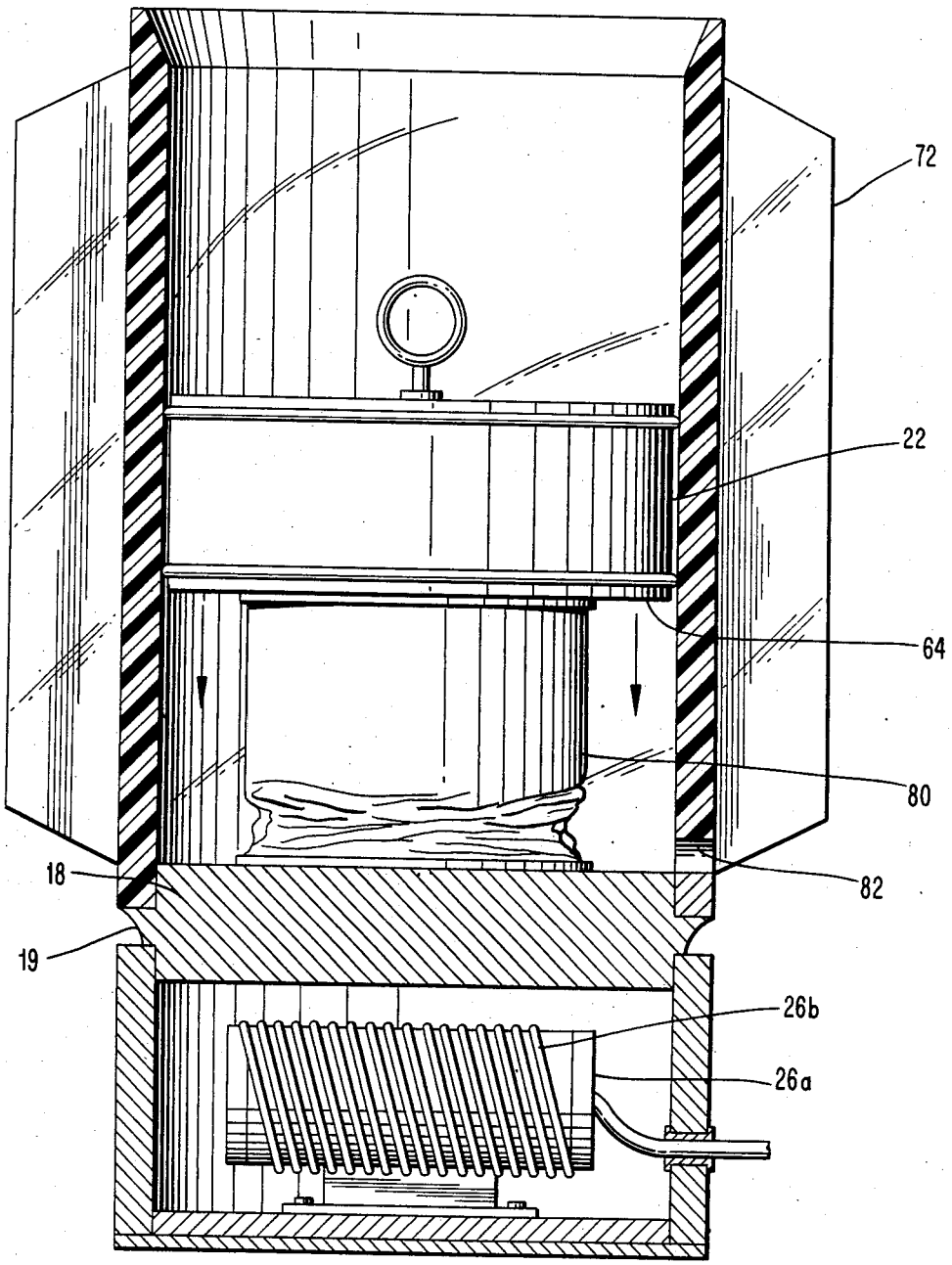
FIG. 5 is a side, partially cut-away view of a second embodiment of the press in operation with a beverage can depicted in partial compression.

In a second embodiment, as shown in FIG. 5, the compacting means or piston 22 is magnetic or, at least, has a magnetic lower end 64 and the arrangement 26 for drawing the piston 22 toward the floor 18 of the housing is an electromagnet **26*a*. The electromagnet 26*a* is of conventional design and includes an armature 26*b* which generates a magnetic field for drawing the piston 22 downward toward the housing floor 18. The electromagnet 26*a* is preferably positioned adjacent the floor 18 of the housing and is capable of developing sufficient electromagnetism to attract the piston 22 toward the housing floor to crush an object such as a single serving beverage can positioned between the piston and the floor. It is preferred that a small opening(s) 82 be provided in the walls of the cavity 20 to permit the escape of air during downward movement of the piston 22**.

The operation of the first embodiment of the vacuum press will now be described in detail with reference to FIGS. 1–4 and 6.

Prior to operation of the press, the piston 22 is lifted and removed from the housing cavity 20. The interior of the housing cavity may be coated lightly with a lubricant such as silicon or vegetable oil to facilitate piston travel within the cavity. An object to be compacted, such as a single serving beverage can 80, is inserted into the housing cavity 20, preferably in a manner such that the can opening is positioned adjacent the central orifice **41*a* of the flow dispersion plate 41 of the diverter. Positioning the can 80 within the cavity 20 in this manner provides for substantially simultaneous evacuation of the interior of the can 80 by way of the orifice 41*a* of the dispersion plate 41 and the housing cavity 20 by the passages 41*b* radiating from the orifice 41*a***, thereby facilitating can crushing.

Once the can 80 has been positioned within the press housing 12, the piston 22 is inserted back into the cavity 20 and positioned into abutment with an end of the can. The press is then turned on by tripping the switch 23, which actuates the pump 26. The vent port 44 is closed, either by covering the vent port 44 with a finger of the operator or by closing a suitable valve to create a vacuum within the can 80 and the cavity 20. Sufficient negative pressure is developed within both the interior of the can and the portion of the cavity 20 between the housing floor 18 and the lower end 64 of the piston 22 to draw the piston downward toward th housing floor and in the direction of the arrows depicted in FIG. 2 to substantially crush the can 80. Upon completion of the compacting cycle, the vent port 44 is uncovered or the valve is opened to diminish the negative pressure within the cavity 20 and to facilitate removal of the piston 22 therefrom.

The operation of the second embodiment (FIG. 5) is substantially similar to that of FIGS. 1–4 and 6. The electromagnet **26*a* draws the piston 22** downwardly toward the floor of the cavity and additional details of the operation of the second embodiment that are similar to that of the first embodiment will not be described in detail.

Since the piston 22 is drawn downwardly, the force of gravity substantially aids in the crushing movement of the piston, particularly when additional weights 58 or other mass changing means 58' are employed. Also, the arrangement of drawing the piston downward eliminates the need for a reinforced press top or cover portion which otherwise would be required if press operation (i.e., piston movement) was in an upward direction, i.e., against the force of gravity. Since the weight of the piston 22 is directed downward in the direction of gravity and toward the floor of the press housing 18, the risk of accident is greatly diminished, as there is no risk of the piston being propelled out of the top of the press.

The press of the present invention provides an apparatus for crushing small scale objects such as aluminum beverage containers that is inexpensive to operate and requires little or no regular maintenance. Because the press is arranged to operate on standard household current or batteries and is made from relatively inexpensive materials, a press may be manufactured that is both compact in size and inexpensive to produce. It is believed that wide distribution of the press described above will stimulate aluminum beverage container recycling efforts by providing an entertainment incentive for collecting beverage containers for crushing by the press. In addition, the handling of containers for recycling will be simplified, as crushed containers are more easily and economically handled than are non-crushed containers.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by others without departing from the spirit of the present invention. Accordingly, the foregoing detailed description should be considered exemplary in nature and not limited to the scope and spirit of the invention as set forth in the attached claims.

What is claimed is:

1. A self-contained, manually portable press for compacting small scale objects, comprising:

a hollow, cylindrical housing having a floor and sidewalls extending substantially perpendicularly therefrom to define a housing cavity;

compacting means slidable within said housing cavity, said compacting means including means arranged to travel with said compacting means in said housing cavity in close proximity to said sidewalls; and means for drawing said compacting means toward said floor of said housing cavity, said drawing means being arranged within the housing for drawing said compacting means downwardly with sufficient force to substantially crush an object positioned between the compacting means and the floor of the housing cavity.

2. The press recited in claim 1, wherein the compacting means includes a piston and said means for drawing the piston toward the floor of the housing includes means for producing negative pressure within said housing.

3. The press recited in claim 2, wherein said means for producing negative pressure is a vacuum pump, said pump being mounted within a chamber adjacent said housing cavity.

4. The press recited in claim 3, wherein said chamber includes a vent port for selectively admitting atmospheric pressure within the chamber.

5. A press for compacting small scale objects, comprising:

a hollow, cylindrical housing having a floor and sidewalls extending substantially perpendicularly therefrom to define a housing cavity;

compacting means slidable within said housing cavity, said compacting means including means arranged to travel with said compacting means in said housing cavity in close proximity to said sidewalls; and means for drawing said compacting means toward said floor of said housing cavity, said drawing means being arranged to draw said compacting means downwardly with sufficient force to substantially crush an object positioned between the compacting means and the floor of the housing;

wherein the compacting means includes a piston and said means for drawing the piston toward the floor of the housing cavity includes means for producing negative pressure within said housing;

said press further comprising diverting means for diverting at least a portion of said negative pressure to an interior of an object to be compacted.

6. The press recited in claim 5, wherein said diverting means comprises an aperture formed therein for diverting at least a portion of said negative pressure to the interior of the object.

7. The press recited in claim 6, wherein said diverting means further comprises flow dispersion means, said flow dispersion means having an orifice formed generally centrally therein and a plurality of passages radiating therefrom for directing substantially simultaneous evacuation of the interior of the object and a portion of said housing cavity beneath said piston.

8. The press recited in claim 6, wherein said diverting means further comprises a plurality of passages radiating outwardly from said aperture for directing evacuation of a portion of the housing cavity beneath the piston substantially simultaneously with evacuation of the interior of the object.

9. The press recited in claim 1, wherein said compacting means includes a piston, said piston having guide means for guiding the piston during its travel within the housing and sealing means for substantially sealing a portion of the housing cavity beneath the piston.

10. The press recited in claim 9, wherein said guide means and said sealing means each includes a substantially annular member mounted circumferentially around said piston and extending beyond a circumferential edge of said piston into engagement with said sidewalls.

11. The press recited in claim 9, wherein said guide means and said sealing means are formed in one piece with said piston.

12. The press recited in claim 9, wherein said piston includes means for changing the mass of said piston.

13. The press recited in claim 12, wherein said mass changing means includes a selectively fillable cavity positioned within the piston.

14. The press recited in claim 12, wherein said piston has an upper surface and where said means for changing the mass of said piston includes at least one weight arranged to be received on said upper surface.

15. The press recited in claim 9, wherein the piston is made of magnetic material and the means for drawing the piston toward the floor of the housing is an electromagnet.

16. The press recited in claim 1, wherein the sidewalls of the housing are transparent.

17. The press recited in claim 1, wherein said housing is reinforced by a plurality of reinforcing ribs, each of said reinforcing ribs extending radially outwardly from said housing along at least a portion of the length of the housing.

18. A self-contained, manually portable press for compacting small scale, light-weight objects, comprising:

a hollow, cylindrical housing having a cavity formed by a floor and sidewalls extending substantially vertically therefrom;

a piston freely slidable within said housing cavity, said piston including guide means for guiding the piston within said housing cavity in close proximity to said sidewalls and sealing means for substantially sealing a portion of the housing cavity between the piston and the floor of the housing cavity; and a source of negative pressure arranged within the housing and beneath the floor of said housing cavity for drawing said piston downwards toward the floor of the housing cavity with the aid of gravity, said negative pressure being sufficient to draw said piston with sufficent force to substantially crush an object positioned between the piston and the floor of the housing cavity.

19. The press recited in claim 18, wherein said piston includes means for changing the mass of the piston.

20. The press recited in claim 19, wherein said piston mass changing means includes a selectively fillable cavity positioned within the piston.

21. A press for compacting small scale, light-weight objects, comprising:

a hollow, cylindrical housing having a floor and sidewalls extending substantially vertically therefrom;

a piston freely slidable within said housing, said piston including guide means for guiding the piston within said housing in close proximity to said sidewalls and sealing means for substantially sealing a portion of the housing beneath the piston;

a source of negative pressure for drawing said piston downwards toward the floor of the housing with the aid of gravity, said negative pressure being sufficient to draw said piston with sufficient force to substantially crush an object positioned between the piston and the floor of the housing; and diverting means for diverting at least a portion of said negative pressure to an interior of an object to be compacted.

22. The press recited in claim 21, wherein said diverting means includes an aperture for directing at least a portion of said negative pressure to the interior of the object and a plurality of passages radiating outwardly from said aperture for directing evacuation of a portion of the housing cavity beneath the piston substantially simultaneously with evacuation of the interior of the object.

23. A press for compacting small scale objects, comprising:

a hollow, transparent cylindrical housing having a floor and sidewalls extending substantially vertically therefrom, said housing being reinforced by a plurality of reinforcing ribs, each of said reinforcing ribs extending radially outwardly from the housing along at least a portion of the length of the housing;

a piston freely slidable within said housing, said piston having guiding means for guiding the piston within said housing in close proximity to said sidewalls and sealing means for sealing a portion of the housing cavity beneath the piston, said piston having a selectively fillable cavity formed therein for changing the mass of the piston;

a vacuum pump mounted within a chamber adjacent said housing, said chamber including a vent port for selectively admitting atmospheric pressure within the chamber, said vacuum pump being arranged to develop sufficient negative pressure within said housing to draw the piston toward the floor of the housing with sufficient force to substantially crush an object positioned between the piston and the floor of the housing; and diverting means including an aperture for diverting at least a portion of said negative pressure to an interior of the object and a plurality of passages radiating outwardly from said aperture for directing evacuation of a portion of the housing cavity beneath the piston substantially simultaneously with evacuation of the interior of the object.

* * * * *